US006863415B2

(12) United States Patent
Lu

(10) Patent No.: US 6,863,415 B2
(45) Date of Patent: Mar. 8, 2005

(54) CUP PADS HAVING LIGHT EMITTING MEMBERS

(76) Inventor: Shang-Kuai Lu, No. 334, Wucyuan Rd., North District, Taichung City 404 (TW)

( * ) Notice: Subject to any disclaimer, the term of this patent is extended or adjusted under 35 U.S.C. 154(b) by 72 days.

(21) Appl. No.: 10/452,502

(22) Filed: Jun. 3, 2003

(65) Prior Publication Data

US 2004/0246705 A1 Dec. 9, 2004

(51) Int. Cl.[7] ..... F21V 33/00
(52) U.S. Cl. ..... 362/101; 362/154; 362/394; 362/806
(58) Field of Search ..... 362/101, 96, 249, 362/251, 394, 154, 234

(56) References Cited

U.S. PATENT DOCUMENTS 4,886,183 A * 12/1989 Fleming ..... 220/739
5,010,461 A * 4/1991 Saotome ..... 362/101
5,119,279 A * 6/1992 Makowsky ..... 362/101
5,307,250 A * 4/1994 Pearson ..... 362/101
5,575,553 A * 11/1996 Tipton ..... 362/101
5,990,790 A * 11/1999 Lusareta ..... 340/571
6,092,905 A * 7/2000 Koehn ..... 362/101
6,164,793 A * 12/2000 Wu ..... 362/101
6,443,589 B1 * 9/2002 Lee ..... 362/101

* cited by examiner

*Primary Examiner*—Alan Cariaso
*Assistant Examiner*—Ali Alavi
(74) *Attorney, Agent, or Firm*—Rosenberg, Klein & Lee

(57) ABSTRACT

A cup pad includes a top part having a recessed area for a cup to put therein and a plurality of first holes are defined through the recessed area. A plurality of second holes are defined through the top part and located around the recessed area. A bottom part is engaged with the top part and an electric power source is connected to the bottom part. A circuit board is sandwiched between the top part and the bottom part. A plurality of first light emitting members are inserted in the first holes and second light emitting members are inserted in the second holes. These light emitting members are controlled by a control chip on the circuit board so as to light up in a pre-determined way.

6 Claims, 6 Drawing Sheets

CUP PADS HAVING LIGHT EMITTING MEMBERS

FIELD OF THE INVENTION

The present invention relates to a cup pad having first light emitting members on a center of a recessed area thereof and second light emitting members located around the recessed area.

BACKGROUND OF THE INVENTION

A conventional cup pad is made of plastic or even cord so as to prevent heat from being transferring to the top of the table. Most of the conventional cup pads are decorated with different patterns and colors so as to increase their value. However, whatever the decoration of the conventional pads is made, the pads are hardly attract people's attention because there are similar decorations and colors around the users so that the cup pads cannot play an attractive role and this inherent problem is one of the main concerns for the manufacturers of the cup pads.

The present invention intends to provide a cup pad that includes first tight emitting members on a central area of the pad and second light emitting members around the central area, such that the pad can be an attractive item.

SUMMARY OF THE INVENTION

In accordance with one aspect of the present invention, there is provided a cup pad which comprises a top part and a bottom part connected to the top part. The first part has a recessed area for receiving a cup and a plurality of first holes are defined through the recessed area and a plurality of second holes are defined through the top part and located around the recessed area. An electric power source is connected to the bottom part so as to provide electric power to a circuit board sandwiched between the top part and the bottom part. A plurality of first light emitting members and second light emitting members are located on the circuit board. A control chip on the circuit board controls the first light emitting members and the second light emitting members. The first light emitting members are inserted in the first holes and the second light emitting members are inserted in the second holes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
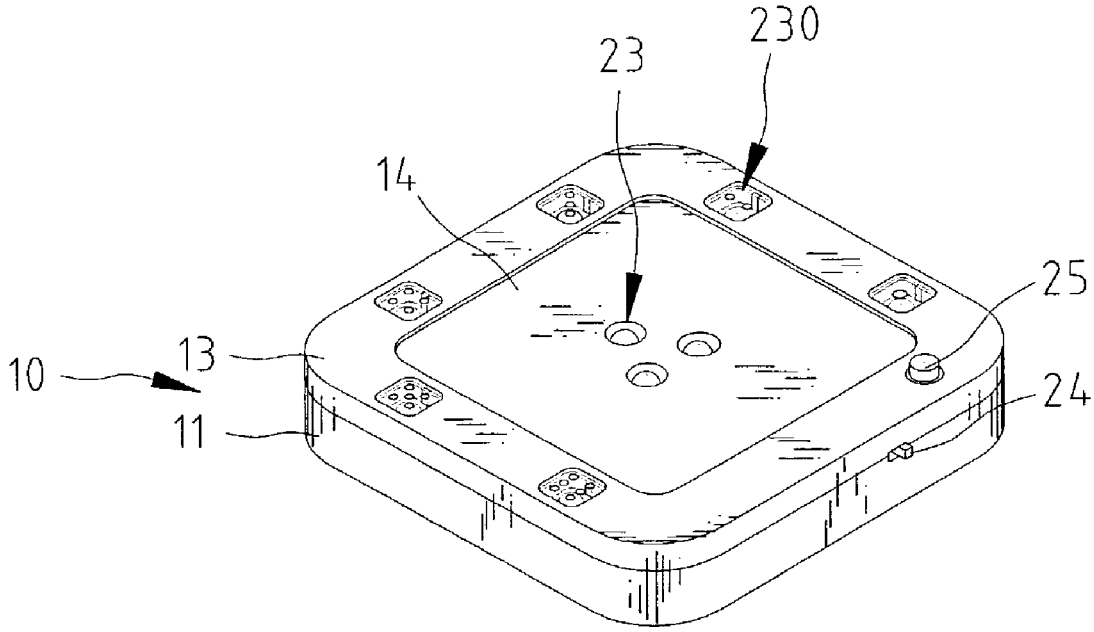
FIG. 1 is a perspective view to show the cup pad of the present invention.
Figure 2:
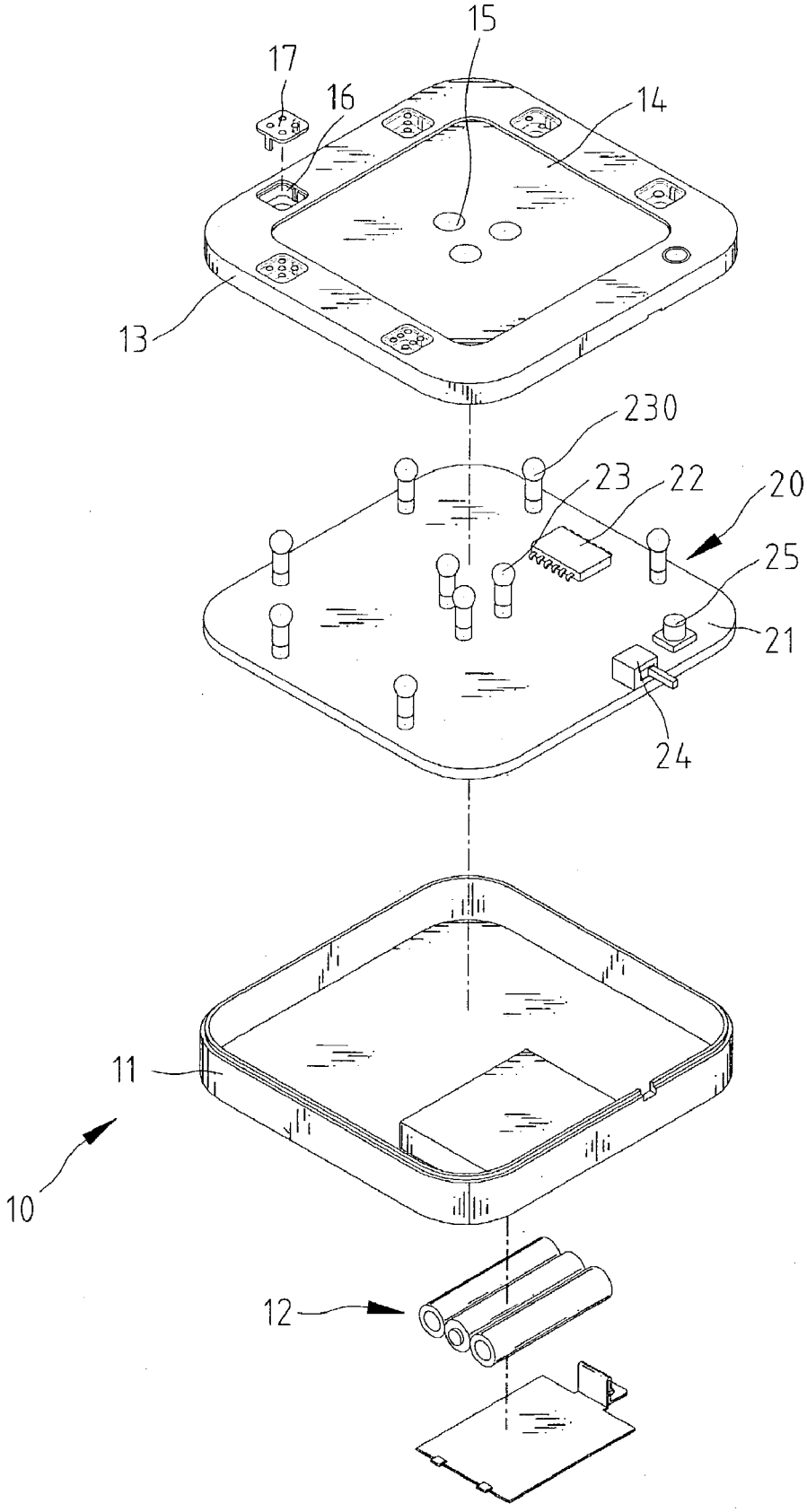
FIG. 2 is an exploded view to show the cup pad of the present invention.
Figure 5:
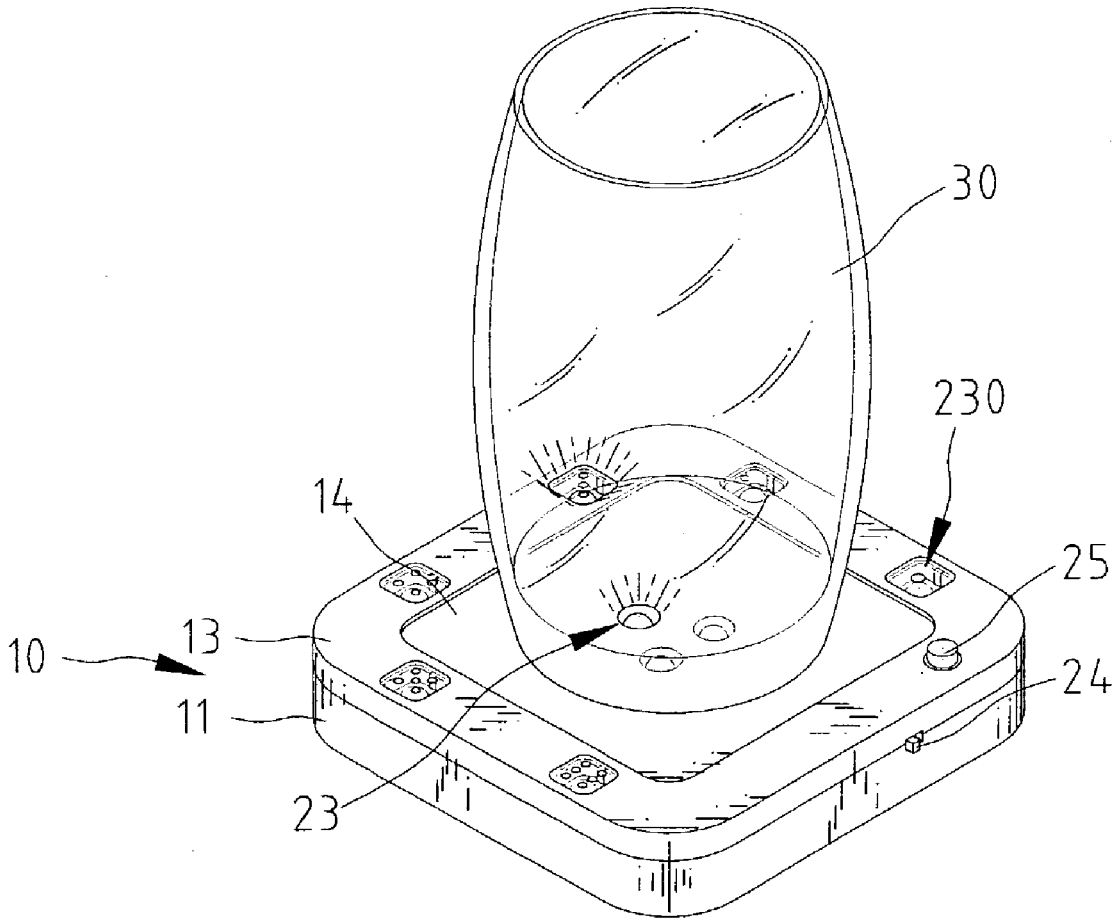
FIG. 5 shows a glass cup is put on the cup pad of the present invention.

Referring to FIGS. 1 and 2, the cup pad 10 of the present invention comprises a top part 13, a bottom part 1 which is engaged with the top part 13 and a circuit board 20 which is sandwiched between the top part 13 and the bottom part 11. The top part 13 has a recessed area 14 defined in a top thereof so that a cup 30 as shown in FIG. 5 may put in the recessed area 14. A plurality of first holes 15 are defined through the recessed area 14. A plurality of second holes 16 are defined through the top part 13 and located around the recessed area 14. A transparent cover 17 is engaged with each of the second holes 16 and can be decorated to have different number of dots on it.

Figure 3:
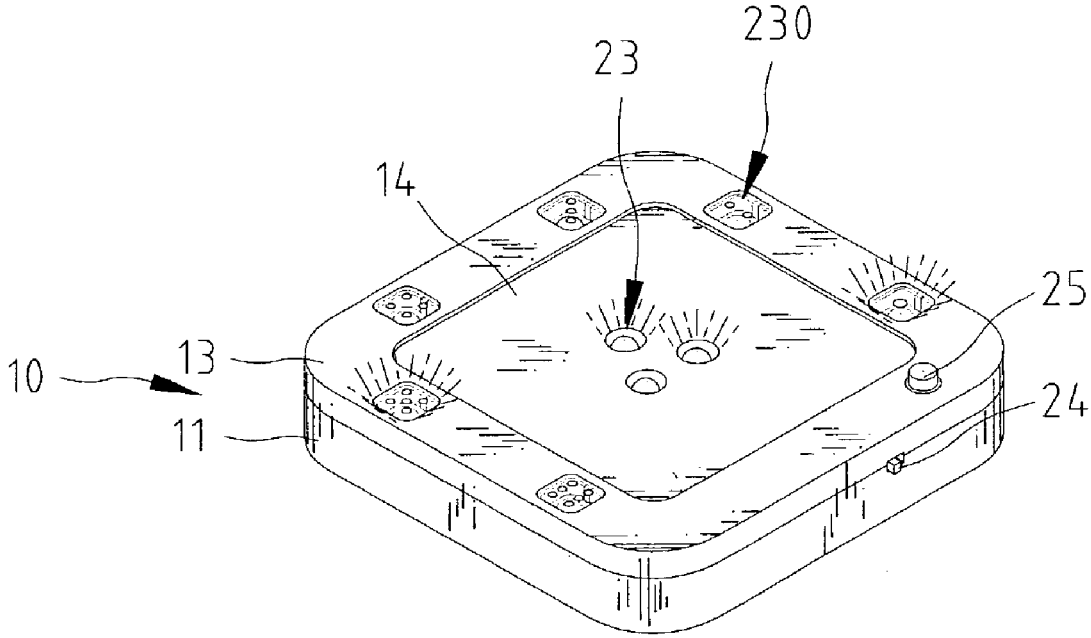
FIGS. 3 and 4 show different the first light emitting members and the second light emitting members are activated.
Figure 4:
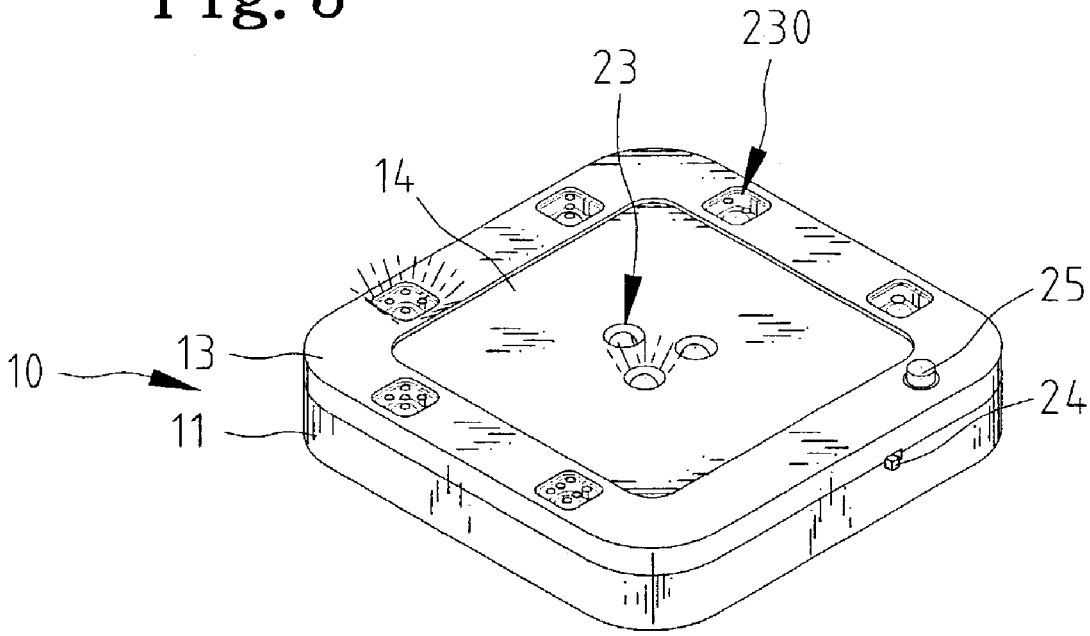

The bottom part 11 has a space for receiving an electric power source 12 such as batteries therein. The circuit board 20 has a plurality of first light emitting members 23 and second light emitting members 230 thereon, and a control chip 22 is located on the circuit board 20 so as to control the first light emitting members 23 and the second light emitting members 230 in a pre-determined way. The first light emitting members 23 are inserted in the first holes 15 and the second light emitting members 230 are inserted in the second holes 16. A main switch 24 is on the circuit board 20 and extends through a side hole defined in a side of the bottom part 11. A reset switch 25 is on the circuit board 20 and extends through a surface hole defined in the top of the top part 13. Therefore, the user may push the reset switch 25 or the main switch 24 to let the light emitting members 23, 230 to light up as shown in FIGS. 3 and 4. In other words, the cup pad 10 of the present invention can be used to play bingo game by using the second light emitting members 230.

Figure 7:
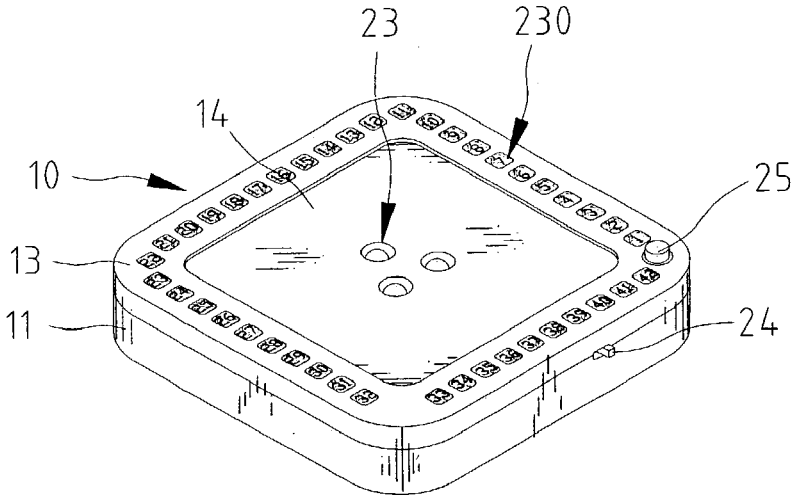
FIG. 7 shows the number of the second holes is more than that in FIG. 1.

FIG. 7 shows that the number of the second holes 16 is more than that in FIG. 1. The number of the second holes 16 can be set to be the same number of the sets of digits of lottery. By this arrangement, the user may play games by using the light emitting members 230 in the second holes 16.

Figure 6:
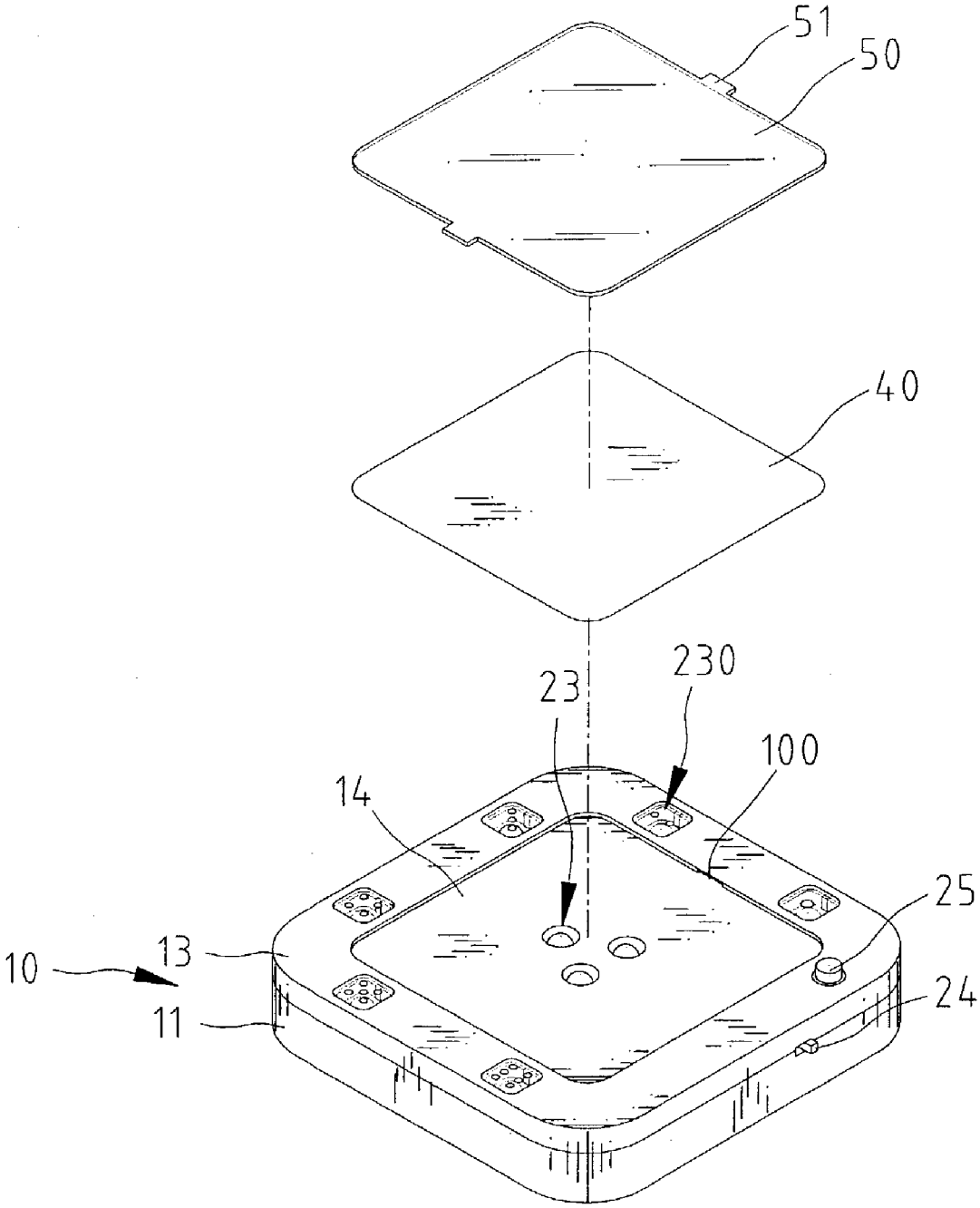
FIG. 6 shows a decoration sheet and a transparent sheet are respectively mounted to the recessed area.

FIG. 6 shows that a decoration sheet 40 received in the recessed area 14 and a transparent sheet 50 is mounted onto the decoration sheet 40. The transparent sheet 50 having two lugs 51 on two sides thereof and the two lugs 51 are engaged with slits 100 defined in two vertical surfaces of the recessed area 14.

Figure 8:
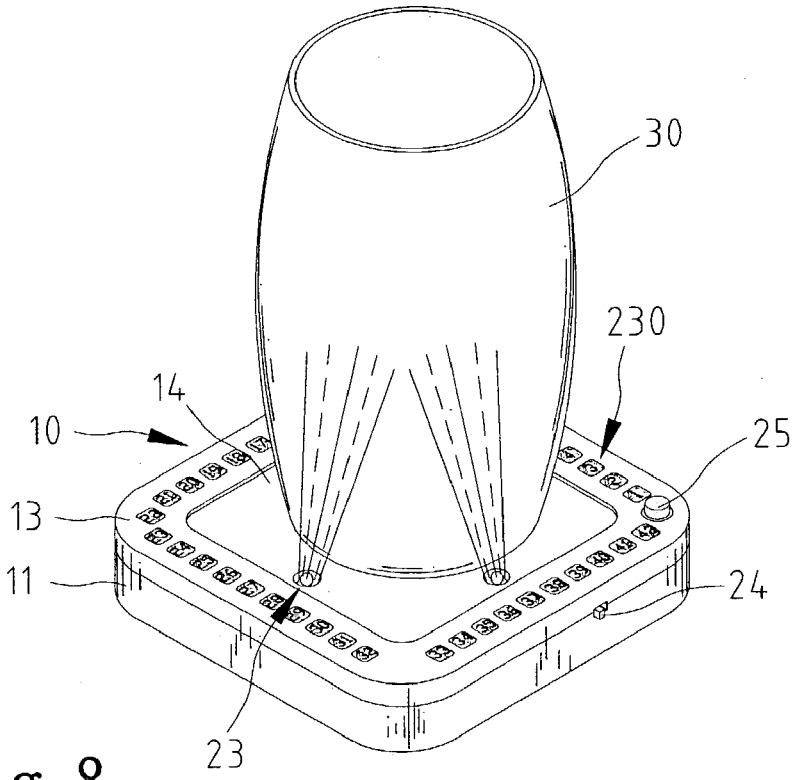
FIG. 8 shows the inclined first holes guide light beams on the cup.

FIG. 8 shows that an axis of each of the first holes 15 is inclined and toward a center of the recessed area 14, so that the light beams of the first light emitting members 23 are on the cup 30.

While we have shown and described the embodiment in accordance with the present invention, it should be clear to those skilled in the art that further embodiments may be made without departing from the scope of the present invention.

What is claimed is:

1. A cup pad comprising:

a top part having a recessed area defined in a top thereof and a plurality of first holes defined through the recessed area, a plurality of second holes defined through the top part and located around the recessed area;

a bottom part engaged with the top part and an electric power source is connected to the bottom part, and a circuit board sandwiched between the top part and the bottom part, a plurality of first light emitting members and second light emitting members on the circuit board, a control chip on the circuit board and controlling the first light emitting members and the second light emitting members, the first light emitting members inserted in the first holes and the second light emitting members inserted in the second holes.

2. The cup pad as claimed in claim 1, wherein a main switch is on the circuit board and extends through a side hole defined in a side of the bottom part.

3. The cup pad as claimed in claim 1, wherein a reset switch is on the circuit board and extends through a surface hole defined in the top of the top part.

4. The cup pad as claimed in claim 1, wherein an axis of each of the first holes is inclined and toward a center of the recessed area.

5. The cup pad as claimed in claim 1, wherein a transparent cover is engaged with each of the second holes.

6. The cup pad as claimed in claim 1 further comprising a decoration sheet received in the recessed area and a transparent sheet is mounted onto the decoration sheet, the transparent sheet having two lugs on two sides thereof and the two lugs engaged with slits defined in two vertical surfaces of the recessed area.

* * * * *